US006679005B1

(12) United States Patent
Cebulla

(10) Patent No.: US 6,679,005 B1
(45) **Date of Patent: *Jan. 20, 2004**

(54) SEALING PROFILE INCLUDING REINFORCING SLIDING HARD LAYERS

(76) Inventor: Ronald Cebulla, Metzendorfer Weg 20, 21224, Rosengarten/Tötensen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/302,514

(22) Filed: Apr. 30, 1999

(30) Foreign Application Priority Data

May 2, 1998 (DE) ..... 298 08 406 U
Sep. 4, 1998 (AT) ..... 582/98 U

(51) Int. Cl.[7] ..... E06B 7/22
(52) U.S. Cl. ..... 49/489.1; 49/475.1
(58) Field of Search ..... 49/498.1, 489.1, 49/495.1, 475.1

(56) References Cited

U.S. PATENT DOCUMENTS

| | | | | | |
|---|---|---|---|---|---|
| 1,998,791 | A | * | 4/1935 | Schanz | 49/489.1 |
| 3,448,543 | A | * | 6/1969 | Multer | 49/470 |
| 3,837,120 | A | * | 9/1974 | Hanks et al. | 49/489.1 |
| 4,328,273 | A | | 5/1982 | Yackiw | |
| 4,535,564 | A | | 8/1985 | Yackiw | |
| 4,538,380 | A | * | 9/1985 | Colliander | 49/475.1 |
| 4,658,548 | A | * | 4/1987 | Gerritsen | 49/498.1 |
| 4,676,856 | A | | 6/1987 | Shigeki et al. | |
| 5,005,317 | A | * | 4/1991 | Sant-Louis Augustin et al. | 49/495.1 |
| 5,007,202 | A | * | 4/1991 | Guillon | 49/441 |
| 5,096,757 | A | * | 3/1992 | Chen | 428/36.8 |
| 5,207,029 | A | * | 5/1993 | Nozaki et al. | 49/495.1 |
| 5,437,124 | A | * | 8/1995 | Ahlfeld et al. | 49/479.1 |
| 5,622,414 | A | * | 4/1997 | Artwohl et al. | 312/116 |
| 5,649,405 | A | * | 7/1997 | Morihara et al. | 52/716.1 |
| 5,916,075 | A | * | 6/1999 | Tanaka et al. | 49/441 |

FOREIGN PATENT DOCUMENTS

| | | | | |
|---|---|---|---|---|
| DE | U81 28 016.5 | | 2/1982 | |
| DE | U84 18 539.2 | | 9/1984 | |
| DE | 42 01 340 | | 9/1993 | |
| DE | 4228987 | * | 3/1994 | 49/475.1 |
| DE | 9402689 | | 5/1994 | |
| DE | 43 18 685 | | 8/1994 | |
| DE | 44 02 604 | | 6/1995 | |
| DE | 296 09 976 | | 10/1996 | |
| DE | 297 19 603 | | 2/1998 | |
| DE | 197 06 804 | | 8/1998 | |
| DE | 196 40 041 | | 9/1998 | |
| EP | 247533 | * | 12/1987 | 49/489.1 |
| EP | 436 810 | | 7/1991 | |
| EP | 570269 | * | 11/1993 | 49/475.1 |
| FR | 2 440 501 | | 5/1980 | |

* cited by examiner

*Primary Examiner*—Gregory J. Strimbu
(74) *Attorney, Agent, or Firm*—Mattingly, Stanger & Malur

(57) ABSTRACT

A sealing profile, in particular for windows and doors, includes a holding section and a sealing section. A web portion of the holding section comprises a projecting holding lip which is linked articulately to a wall of the sealing profile, yielding resiliently on expansion of the sealing profile in situ. The web portion on its side facing towards an associated receptacle is provided with at least one layer extending longitudinally and transversely to the direction of insertion of the sealing profile so as to assist sliding insertion of the web portion, which layer is made of a material harder than the material of the web portion provided with the layer, wherein the web portion in a region of contact between the projecting holding lip and the receptacle is free from the hard layer. The latter acts as a rigid pivot element which impedes the removal of the sealing profile from the receptacle.

21 Claims, 4 Drawing Sheets

SEALING PROFILE INCLUDING REINFORCING SLIDING HARD LAYERS

BACKGROUND OF THE INVENTION

1. Field of the Invention

The invention concerns a sealing profile, in particular for windows, doors or the like, including a holding section on the base, pedestal, foot or bottom side (in the following defined and used as "bottom side") of the sealing profile with at least one holding means provided for engaging in a receptacle, and a sealing section joined to the holding section. The holding means is formed by a leg-like web portion which comprises a projecting holding lip and which is linked articulately to a wall extending longitudinally with the sealing profile and forming a bottom trunk of the holding section. The web portion yields against an elastic material return force as a result of insertion in the receptacle. Seals of the kind mentioned can be used for a number of applications. They serve preferably to seal off a window casement from a window frame or a door leaf from a door frame. They prevent the entry of air and/or moisture through the element to be sealed and additionally act as sound insulation.

2. Prior Art

To obtain a high sealing effect, known sealing profiles are made, at least in part, of soft material. Soft elastic materials are however relatively costly. Therefore non-sealing regions are made of harder cheaper material. Thus seals are known (DE-U1-296 09 976) in which regions which assume a sealing function are made of thermoplastic elastomers (TPE) and other regions are made of ethylene vinyl acetate (EVA). Known sealing profiles also have tension-resistant inlays (e.g. DE-U1-9402689.0, EP-A1-0436810). The inlays serve to take up tensile forces which arise during seal assembly, and they limit the elongation, namely stretching of the profile. The tension-resistant inlays are usually made from wires or textile, polyester or cotton threads. The wires and threads impede reuse and recycling of the sealing profile material, as the material components are not compatible and it is uneconomical to separate them for recycling.

Also known are sealing profiles (e.g. DE-U1-9402689.0, EP-A1-0436810) which are provided with a reinforcing rear wall made of a material which is substantially harder than that of the remaining extruded seal. The hard wall is intended to prevent bending on insertion of the seal in the receptacle and to form a sliding aid for introduction into the receptacle. The hard wall must be clamped fast enough against the receptacle wall by at least one holding lip. For this purpose the articulated link of the sealing lip is to be relatively stiff. In order to facilitate insertion of the seal in the receptacle, however, internal recesses are provided in the region of the link (DE-U1-9402689.0). This leads to weakening of the clamping action and consequently unwanted release from the receptacle groove. This is countered by the fact that several holding lips are provided.

Another known sealing strip consisting of a solid profile is formed from elastic soft plastic foam which is coated with a water-repellent layer (U.S. Pat. No. 4,535,564). To fix the sealing strip in a groove, an anchor section formed from the plastic foam is embedded in a hook-like strip. The hook strip is made of a material which is less compressible than the plastic foam. It is intended to give the anchor section strength and to facilitate introduction of the anchor section into an anchor groove. Here the hook strip filled with the elastic spring plastic material is compressed for insertion. The receptacle groove is provided with an additional recess in which a leg of the hook strip is to be engaged under relaxation. Manufacture of the sealing strip with such a hook strip is elaborate. There is a risk of the sealing strip being destroyed on removal from the groove, as the leg of the hook strip which springs open is caught in the associated recess.

SUMMARY OF THE INVENTION

It is the object of the invention to provide a sealing profile which is to be improved particularly with regard to assembly, sealing function, remaining in the profile receptacle, dimensional stability as well as easy, cheap and environmentally friendly manufacture.

This object is achieved according to the invention in combination with the characteristics of the sealing profile of the kind mentioned in the introductory portion, in that the web portion on its side facing towards the associated receptacle is provided with at least one layer extending in the longitudinal direction and transversely to the direction of insertion of the sealing profile and assisting sliding insertion of the web portion into the receptacle. This layer is made of a material harder than the material of the web portion which is provided with the layer, wherein the web portion in the top contact region of the projecting holding lip with the receptacle is free from the hard layer and the hard layer acts as a rigid pivot element, which in at least one zone of the softer material of the web portion makes it hard for the web portion to expand. Thus a number of advantages are obtained. The hard layer provided and arranged according to the invention promotes compression of the web portion, so that a critical reduction of resistance is brought about on insertion of the sealing profile into the associated profile receptacle. The sealing profile passes without the use of lubricants such as silicone oil or the like particularly smoothly with optimum sliding action into the profile groove. The layer of hard material which is continuous over the length of the seal serves as a so-called stretch brake in the form of a hard material core which is integrated in the soft material of the web and which during and after assembly reliably prevents elongation and unwanted deformation of the profile strand. The layer-free web material and the sealing material are substantially more extendible in the longitudinal direction of the profile than the hard layer of the web. As a result of a convex curvature of the profile strand in the longitudinal direction, which convex curvature inevitably forms, insertion in the profile groove with a kind of snap action is promoted. The hard layer of the web which is strip-like over the length of the profile strand, owing to its upright geometry in a direction transversely to the linking wall, ensures high torsion resistance of the profile in the region of the holding lip which makes the clamping connection in the receptacle. On the whole, considerable handling and functional advantages are gained, particularly when mechanically crimping the sealing profile into a profile receptacle. The web portion bridges the profile cross-section of the receptacle in the form of an articulately linked leg. The link region and the leg, which is pivotable about the link region, are shape-retaining, shape-giving parts of the seal. The material of the joint region determines the spring behavior of the linked leg. Here, a significant additional combination effect of the strip-like hard layer of the web lies in that inward expansion/compression of the leg portion when inserted/pressed into the receptacle is substantially easier than outward/upward expansion under tensile stress against the direction of insertion or on removal from the profile receptacle. On account of this marked directional characteristic, the holding section fits snugly and stably in abutment and sealing in the profile receptacle. The hard layer of the web, in the state of the holding section inserted in the associated receptacle, causes a kind of anchorage which considerably improves the sealing fit and sealing stability and function. The hard layer of the leg web which forms an arm-like rigid pivot element acts in connection with the softer leg material as a transversely tilting pressure bar whose compression resistance increases with increasing expansion of the web leg. This is possible due to the fact that, on tilting of the strip-like hard layer, the softer material of the web leg is upset much more in edge and end regions of the hard layer than in its central region. Due to the particular location of applying the hard layer, the anchoring effect depends particularly markedly on the quantity and direction of the force acting on the web portion. Simply by this means is increased adhesion and sealing action of the seal bottom in the associated profile receptacle achieved. With the hard layer of the web, the sealing profile according to the invention is also particularly easy to make, obtaining material savings which lead to cheap manufacture. Not least, particularly as a result of material-saving design of the seal and pronounced anchorage effect, the life and functional time of the seal are increased. But, on the other hand, the compression of the softer material obtained according to the invention on exceeding a given quantity of tensile force acting counter to the direction of insertion also allows non-destructive release of the sealing profile from the profile receptacle.

Advantageously, insertion of the sealing profile in the profile receptacle is promoted not only by the hard layer surface in combination with the softer material of the web portion, but also by the fact that the hard layer on the lower surface of the holding bottom is exposed with a sliding surface.

Particularly advantageously, the holding means of seals according to the invention are constructed as lip and/or cavity profiles by contrast with solid profiles. The web leg portions provided with the hard layer yield during inward compression and upward expansion into material-free space. The groove between the leg portion provided with the hard layer and the wall linking it is free from material, so that on the one hand, inward expansion/compression of the holding leg is promoted, while on the other hand, by means of the selected extent of the hard layer, the upset region in the softer web material is precisely defined and fixed.

In a particularly preferred embodiment of the invention, the web portion is formed by a cavity bottom of arrow-shaped profile. Two leg portions arranged in a V shape and linked each to an associated profile wall and each provided with the hard layer adjoin each other in the region of the arrow-shaped apex. Under the effect of the expansion force, the adjoining portions made of the soft web material are forced against each other by means of the strip-like arm-like hard layers, so that an upset zone counteracting the expansion to a particular extent is formed. Upsetting of the material in the transition region between the two legs can appropriately be provided to a particularly marked extent by the fact that the bottom surface of the holding bottom in the region of the arrow-shaped peak is free from the hard layer.

With known cavity-bottom seals, it is frequently necessary to apply to the whole of the holding section a sliding layer and in particular lubricants such as glycerol or silicone. The use of lubricants is not only cost-intensive and labor-intensive, but also there is a risk of damage to health, and the lubricants pollute the environment. Also, use of the lubricants can impair the sealing action. In case of frequent stress as well as due to environmental effects, e.g. due to humidity, dust and temperature, the sealing fit can be impaired, and there is a risk that the sealing profile will come out of its profile receptacle undesirably, so that disadvantageous sealing gaps arise and also operation of the windows, doors, etc. provided with the sealing profiles is considerably impaired. Such drawbacks are also eliminated by the cavity bottom according to the invention.

In order to produce a progressive anchoring force transversely to the bottom trunk of the sealing profile with the hard layer laid transversely, it is also particularly appropriate to link the holding web portion to a wall which essentially in the central region of the hard layer formed on the web portion is joined to the hard layer by the softer web portion material carrying it.

In another embodiment of the invention, the holding section and the sealing section are joined together by a profile spine, wherein the profile spine is preferably provided with a spine layer which extends as far as the bottom end and which is harder than the spine material of the seal provided with the spine layer. Particularly advantageously, the transition region between the lower side of the web portion and the profile spine remains free from the web portion hard layer.

In all embodiments of the invention, appropriately, the free side end of the web portion forming the holding lip is provided free from the hard layer. It is particularly appropriate, especially for holding lips of an arrow-shaped holding bottom in connection with profile receptacles in metal or plastic elements, that the free end of the web portion forming the holding lip is made of thermoplastic elastomer (TPE), so that it has a braking action against being pulled out.

In an appropriate embodiment, the holding lip, seen in profile cross-section, is provided with at least two holding tips which butt against an associated receptacle wall, wherein a lower holding tip comprises the hard layer and preferably springs back relative to a holding tip above it in the unstressed state.

It is particularly advantageous that the hard layer of the holding web portion can be constructed as a wafer-like layer which is thin compared with the profile thickness of the web portion provided with the hard layer and which is exposed on the lower surface of the bottom.

Preferably, the hard layer is a polyolefin, preferably a polyethylene, the softer portions of the seal being formed from thermoplastic elastomers (TPE). Thus, particular profiles which are ready to assemble can be made by coextrusion in one operation. The bottom hard layer can be applied selectively and partially as well as locally with precision at the points at which it performs the functions described. The material combination described also ensures high dimensional stability and hence a high sealing effect. It is also particularly advantageous that the seal material with all its components can be reused as a recycling product in the form of ground material. Preferably an adapted softer material is added for use with the desired hardness. The recycling product is available cheaply and allows environmentally friendly manufacture.

Subsidiary claims are also aimed at other appropriate and advantageous embodiments of the invention.

BRIEF DESCRIPTION OF THE DRAWINGS

Further advantages and embodiments or possible designs of the invention are apparent from the following description of the practical examples shown in the schematic drawings. They show in.

DESCRIPTION OF THE PREFERRED EMBODIMENTS

Sealing profiles of the kind concerned serve to seal windows, doors or the like and are to be used particularly as a casement or leaf or frame seal. They can also be used as a cover seal, for instance. The practical examples shown in FIGS. 1 to 6 reproduce only some of the many possible applications.

Figure 1:
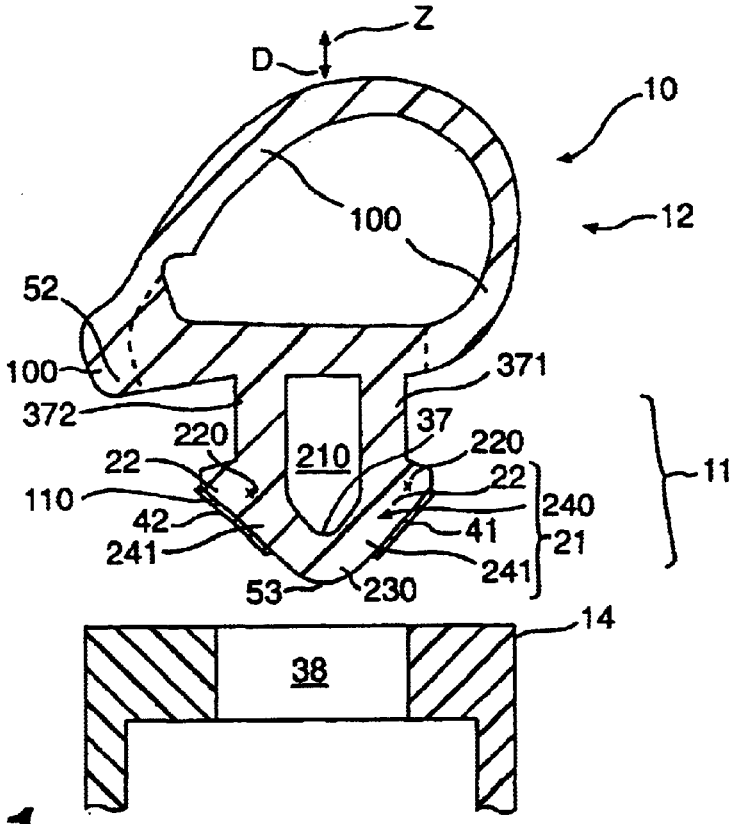
FIG. 1 in profile cross-section a practical example of a sealing profile with arrow-shaped cavity holding bottom, FIG. 2 in profile view a practical example of a sealing profile according to the invention with a cavity holding bottom provided in particular for steel door frames, FIG. 3 in profile view a practical example of a seal according to the invention with a leg holding lip, in particular for wooden windows, FIG. 4 in profile view a practical example of a sealing profile according to the invention with a double web portion holding lip, FIG. 5 in profile view, a practical example of a sealing profile according to the invention with two pairs of web portion holding lips, FIG. 6 in profile view, a practical example of a sealing profile according to the invention with two pairs of web portion holding lips, and FIG. 7 in profile view, a practical example of a stage of exerting tensile force to the sealing profile of FIG. 1.
Figure 2:
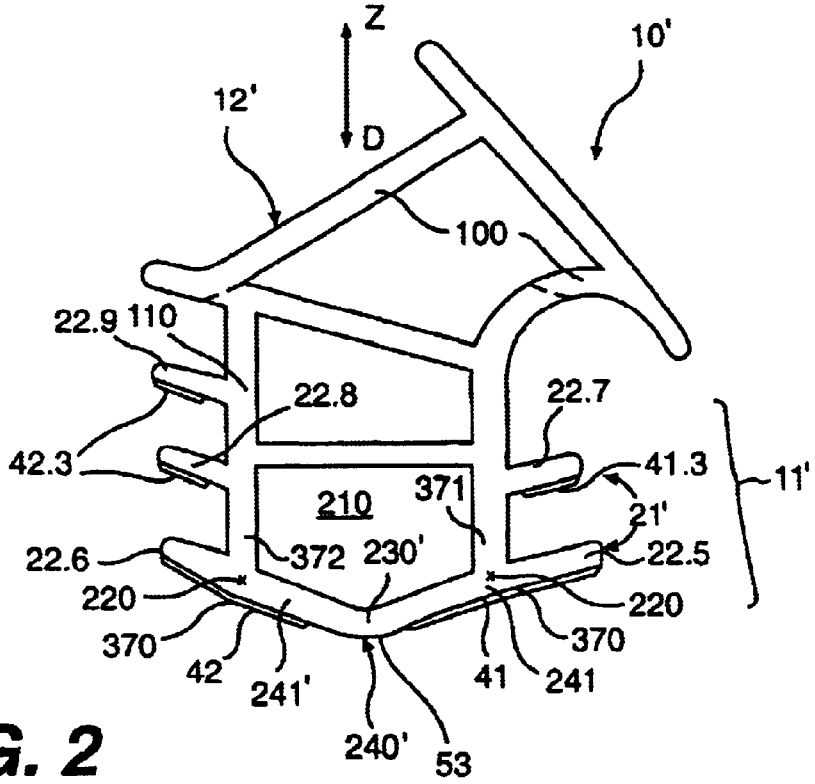
Figure 3:
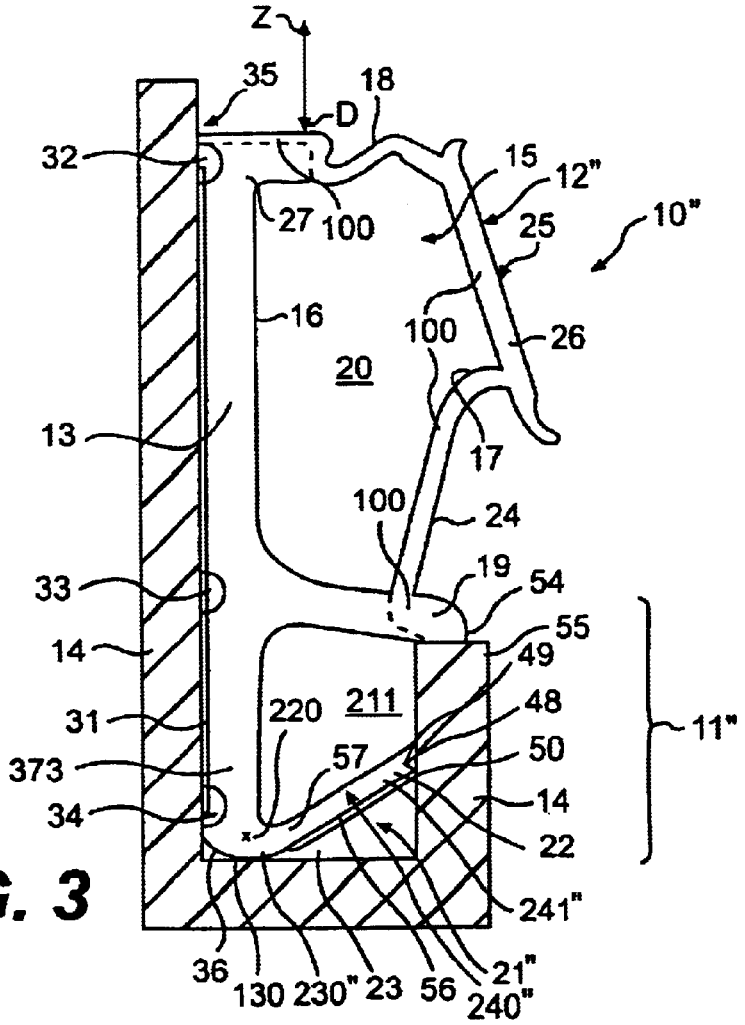
Figure 5:
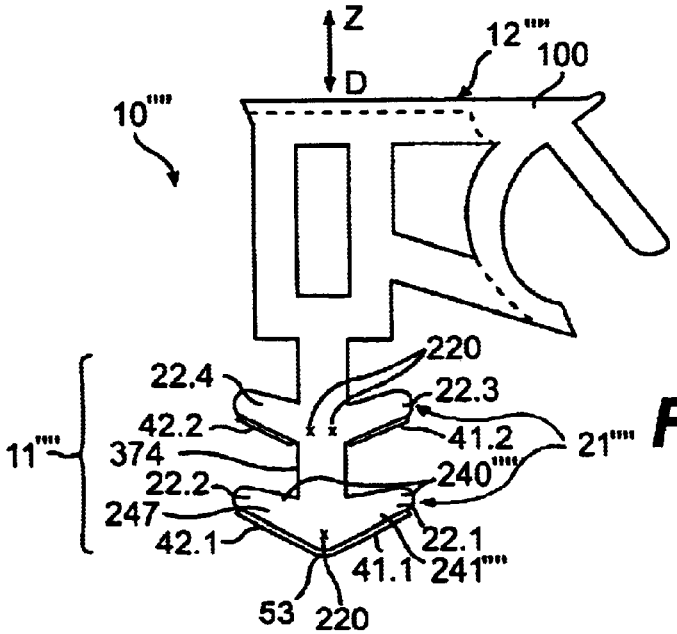
Figure 4:
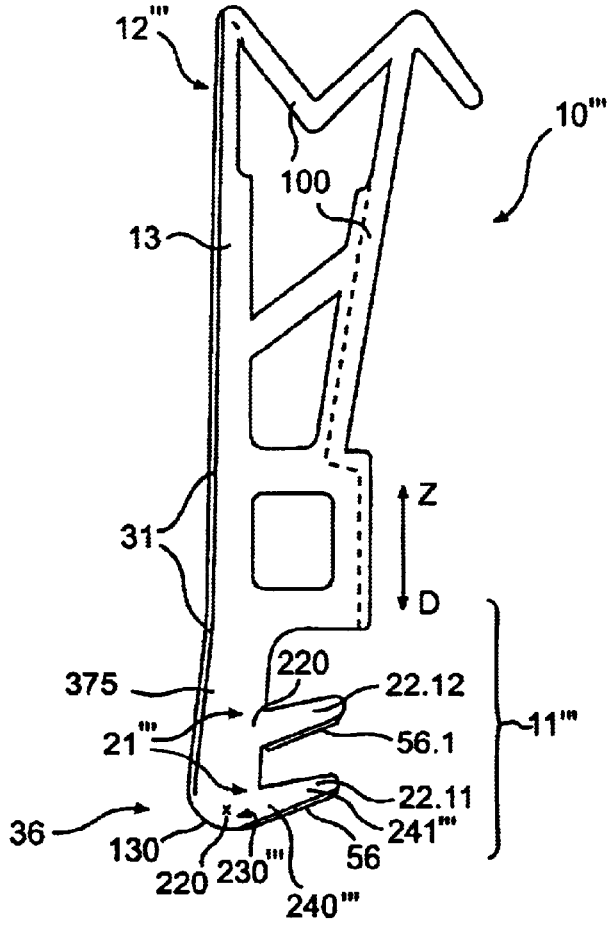
Figure 6:
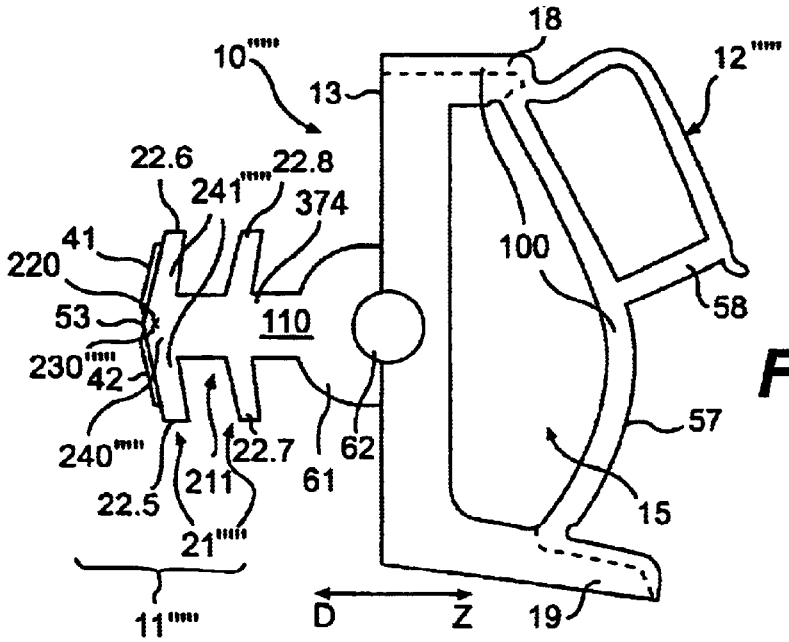

Sealing profiles 10 according to FIGS. 1 to 6 are made by extrusion. They essentially consist of a holding section 11 and a sealing section 12. The holding section 11 arranged on the base, pedestal, foot or bottom side and the sealing section 12 are joined together by web sections (FIGS. 1, 2, 5) or profile spines (FIGS. 3, 4, 6). The holding section 11 is arranged at the base, pedestal, foot or bottom end of the sealing profile 10 and serves to hold it in a profile receptacle 14, the latter being part of a frame, case or encasement.

As all the practical examples illustrate, the holding means 21 includes a web portion 240 which is provided for engaging in a receptacle 14 and in the latter forms a clamping bridge for producing a tight holding fit. The web portion 240 comprises at least one projecting holding lip 22. When seated in the associated profile receptacle 14, the free lip end butts against the receptacle wall.

Each holding web portion 240 is articulately linked to an associated wall which extends longitudinally with the sealing profile 10 and is formed by a bottom trunk 110 of the holding section 11. Thus the web portion 240 is formed by at least one arm-like leg 241 which on insertion of the sealing profile 10 can become erect by pivoting about the region of' an imaginary pivot axis 220. On insertion of tensile force, however, the leg 241 passes increasingly into a position oriented transversely to the bottom trunk 110, which produces across the width of the receptacle 14 a connection which increases tightness of fit. For this purpose each leg 241 of the web portion 240 comprises on its lower side facing towards the associated receptacle 14 a hard layer 41, 42, 56 extending in the longitudinal direction and transversely to the direction of insertion D. This layer is harder than the material of the web portion 240 which is provided with it, and it is exposed at the holding bottom lower surface of the web portion leg 241. The flat hard layer 41, 42, 56 is characterized in that it is relatively pressure-resistant in the direction of its long wide edge, whereas, even though to a lesser degree than the soft web material, it can still be curved or bent to a certain extent in the longitudinal direction. It forms a sliding layer which promotes sliding insertion of the holding means 21 into the receptacle 14. As described in more detail below, the web portions 240 in connection with the hard layers 41, 42, 56 form elements acting as tension rods, their anchoring effect being reinforced in direction Z depending on tensile force.

In the preferred embodiments shown in the figures the sealing profiles 10 are essentially made of thermoplastic elastomer (TPE) which has a resiliency, i.e. an elastic spring return force. The hard layers 41, 42, 56 are made of polyolefin and preferably polyethylene. The material of the hard layer 41, 42, 56 is so hard compared with the softer web material carrying it, that compressive forces applied to the web portion 240 in a direction transversely to the bottom trunk 110 (i.e., horizontally in FIG. 1) are essentially transmitted by the hard layer 41, 42, 56, so that the latter acts as a kind of pressure bar. The web portion 240 or the legs 241 acquire their return spring force from the elasticity of the softer material to which the hard layers 41, 42 are applied. In this case the profile shape of the seal is determined by the web and rib structure formed from the softer material. The wall of the web portion 240 is relatively flat. Its thickness is of the order of magnitude of the thickness of the wall of the bottom trunk 110 linking it. The return force of the link of the web portion is essentially determined by the material section of the transition point between the web portion 240 and the wall linking it.

In the practical example according to FIG. 1 the sealing section 12 is formed by a hollow tubular element with a contact wall 52. The sealing section 12 merges directly with the holding section 11 which is formed by an arrow-shaped cavity bottom. The arrow-shaped bottom section is formed by the web portion 240 which has two legs 241 arranged in a V shape. The legs 241 project with holding lips 22 at the vertical longitudinal side walls of the bottom trunk 110 which is hollow with the cavity 210.

On the lower surfaces of the legs 241 are applied the hard layers 41 or 42 extending with the sealing profile 10. They are formed by a generally planar, strip-like, wafer-like coating. The bottom surface of the holding bottom is free from the hard layer 41 or 42 in the region of the arrow-shaped apex 53.

A profile receptacle 14 associated with the holding bottom comprises a gap-like opening 38 whose width is slightly less than the width of the hollow trunk bottom 110. When the sealing profile 10 is pressed into the receptacle 14, the hard layers 41, 42 are placed in an oblique position against the opening edges. By applying compressive force in the direction of insertion D the legs 241 erect themselves by each pivoting about the region of the associated imaginary pivot axis 220. Each pivot axis region is formed by the fact that the longitudinal wall 371 and 372, respectively, of the bottom trunk 110, seen in bottom profile cross-section, in the central region 370 of the hard layers 41 and 42, respectively, formed on the legs 241 is joined to the hard layer by the softer material of the web portion 240 carrying it.

It can be seen that the upward folding or inward folding by expansion of each leg 241 is made much easier by sliding the hard layers 41, 42 over the opening edges of the gap opening 38 and by moving the legs 241 into the region of the material-free cavity 210. Here it is also an advantage that the two legs 241 in the region of the apex 53 merge with each other only via the relatively soft material of the web portion 240. On insertion of the holding bottom in the groove or opening 38 of the profile receptacle 14, the walls 371, 372 are also forced inwards into the region of the chamber 210, so that upward folding is additionally favored. The bottom passes under snap action into the receptacle 14.

In the inserted state of the sealing profile 10, the walls of the gap opening 38 come to lie in a snug sealing fit between the holding lips 22 and the lower side of the top sealing section 12. The holding lips 22 are free from the hard layers 41, 42 at their top edges 6 which project almost at right angles to the walls 371, 372, so that there the thermoplastic elastomer (TPE) material of the legs 241 is exposed. As a result the adhering and contact edge at the inner edges of the gap opening 38 is particularly pronounced.

Figure 7:
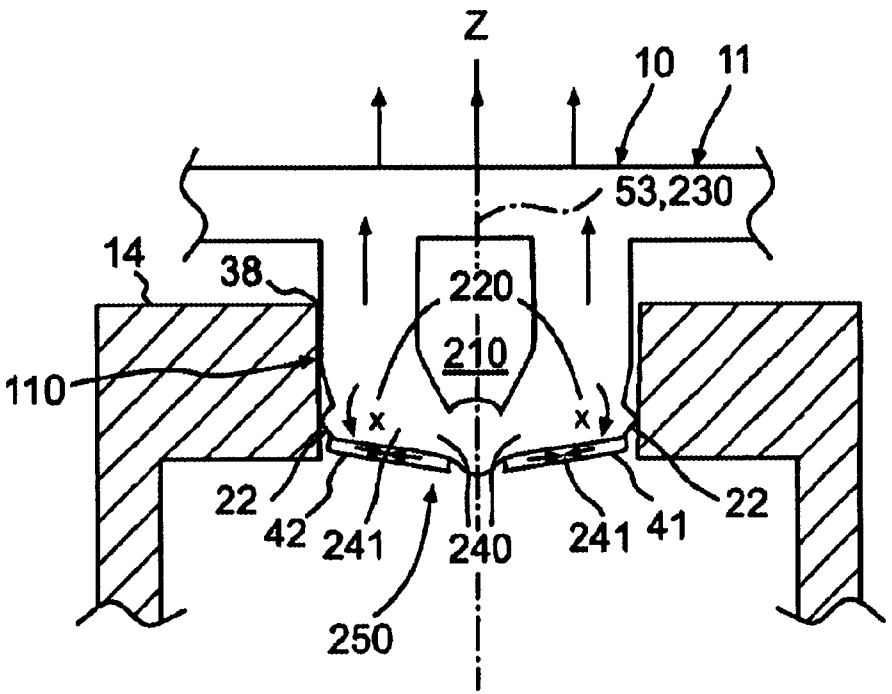

In case of tensile stress in direction Z as shown in FIG. 7, a force is applied to the rubber-like grinding upper edges of the holding lips 22, causing the legs 241 to pivot about the regions of the imaginary pivot axes 220 and so increasingly move into a flatter transverse position in the associated profile receptacle. In the process the softer web material in the region of the apex 53 is compressed, and it is an advantage that the squashed material can escape slightly into the region of the cavity 210. The expansion movement of the V-arms 241 is substantially promoted by the wafer-like hard strip layers 41, 42 which pivot about the regions of the axes 220 and which form arm-like rigid pivot elements. In the process compressive force is also applied to the adhering edges of the holding lips 22, so that in the region of the free edges of the lips 22 upsetting of the soft material and moreover upsetting of the soft material in the region of the apex 53 are caused. Thus the longitudinal edges of the wafer-like strip layer 41, 42 are pressed to a certain degree into the softer web material, so that it is compressed or upset like a kind of flesh material to form the clamping bridge 250 as shown in FIG. 7. In combination with the hard layer 41, 42 acting as a pressure bar in the transverse direction, the degree of keying increases. The tensile resistance of the holding section 11 acting as a tension rod increases with the upward expanding legs 241.

The tension rod effect is so marked that detachment of the sealing profile 10 in continuous longitudinally extending sections is particularly prevented or rather counter-acted. To separate the holding bottom from the profile receptacle 14, the seal is appropriately gripped from one end of the strand and pulled out in direction Z. Hence it is possible to detach the bottom from its profile receptacle 14 against elastic material return force of the soft material.

In FIG. 2 a sealing profile 10' according to the invention (elements with corresponding reference numerals to those of FIG. 1 are distinguished by a prime (')), intended particularly for steel door frames, is shown in the unassembled relaxed state and comprises a holding section 11' and a sealing section 12'. A holding bottom, including holding means 21', is, as in FIG. 1, of hollow construction with a bottom surface of arrow-shaped profile. While the legs 241 in FIG. 1 adjoin each other at an angle of about 90°, the legs 241' according to FIG. 2 merge with each other at a relatively large obtuse angle, and the legs 241' are provided with holding lips 22.5, 22.6 which extend relatively far outwards away from the walls 371, 372 of the bottom trunk 110. Thus the legs 241' can be regarded as particularly marked two-arm levers which are pivotable about the regions of the imaginary pivot axes 220 and whose pivot resistance is determined by the arm-like hard layers 41, 42 acting as rigid pivot elements. Due to the marked obtuse-angled apex region 53 which remains free from the hard layers 41, 42, in combination with the relatively far-projecting holding lips 22.5, 22.6, on the one hand the holding bottom can be pressed particularly smoothly into the groove of the profile receptacle 14 under the action of the resiliency of the softer material of the web portion 240' by pressing the legs 241' together in a V shape. The hard layers 41, 42 are provided with exposed sliding surfaces which additionally help to press in the sealing profile 10' in direction D and so mount and assemble it. On the other hand the apex region 53 under tensile stress in direction Z forms a highly active upset zone 230'. The latter causes a particularly marked clamping force which increases the transverse clamping fit when the legs 241' are expanded (upwards), in the groove of the receptacle 14.

As seen in profile view, the walls 371, 372 of the holding bottom are joined in the central region 370 to the respective hard layers 41, 42 by the softer web material carrying it. Thus the walls 371, 372 with the associated hard layers 41, 42 form particularly active T-shaped anchor structures. During the clamping fit, as a result of elastic spring return force of the web/rib material of the holding section 11', pronounced holding adhesion of the holding lips 22.5, 22.6 at the longitudinal side walls of the profile groove is obtained. This is aided by the fact that the free side ends of the web portion 240' forming the holding lips 22.5, 22.6 are free from the hard layers 41, 42.

The sealing profile 10' according to FIG. 2 comprises additional holding lips 22.7 to 22.9 oriented upwards in profile view in an arrangement one above the other or a ladder arrangement. The two lips 22.8, 22.9 are provided over the lip 22.6. On the other bottom wall 371 above the lip 22.5 is arranged the lip 22.7 which with the lip 22.8 forms a V-shaped keying structure. Appropriately, all these lips are provided on the bottom side with sliding hard layers 41.3 and 42.3. As a result, the legs comprising the upper lips also acquire the attitude described from the hard layers 41.3, 42.3. As shown by all the practical examples, all the hard layers 41.3, 42.3 extending transversely in the profile receptacle 14 act as sliding systems, as transverse pressure bars, as tension resistant cores and as compression elements, wherein also the material of the seal 10' with all components is recyclable by grinding and so can be supplied for environmentally friendly and cheap production. Appropriately, the longitudinal edges of the hard layers 41.3, 42.3 remain so far apart from the walls 371, 372 that in the region of the obtuse-angled hollow grooves or links during upward expansion there is compression of material which impedes this to a particularly pronounced degree.

A sealing profile 10" according to FIG. 3 (elements with corresponding reference numerals to those of FIG. 1 or FIG. 2 are distinguished by a double prime ("')) is particularly suitable for use with wooden windows. The sealing section 12" comprises a hollow profile 15. The latter is formed from a section 16 of the profile spine 13, a contact wall 17 and an upper wall 18 and a lower wall 19. The walls 18, 19 connect the section 16 to the contact wall 17, so that in profile view a cavity 20 closed on all sides is formed.

The holding section 11" has at least one holding means 21". The latter includes a holding lip 22 in the form of a web portion 240" projecting from a bottom wall 373, at the lower end of the holding section 11". The web portion 240" projects away from the profile spine 13 and is slightly inclined in the direction of the wall 19 on the bottom side. The angle formed between the profile spine 13 and the holding lip 22 is smaller than 90°, so that the holding lip 22 on insertion in the profile receptacle 14 automatically folds in the direction of the profile spine 13. The holding lip 22 in combination with a coating 56 which will be described below acts in the profile receptacle 14 as a kind of barb to prevent accidental release or slipping of the sealing profile 10" out of the profile receptacle 14.

The lower wall 19 on the bottom side of the hollow profile 15 is arranged almost perpendicularly to the profile spine 13 and has a width which is greater than the width of a groove 23 of the profile receptacle 14. The lower wall 19 in the assembled state covers the groove 23 and seals it off. At one free end of the lower wall 19 the latter has a formation 54, e.g. a chamfer, groove or the like, which ensures precise sealing between the lower wall 19 and a side wall 55 of the groove 23. In the unstressed state, not shown, the profile spine 13 is directed inwards in the region of the unassembled wall 19. Appropriately the spine section of the holding portion 11" is set slightly obliquely outwards with a slight inclination towards the bottom side. In the assembled state according to FIG. 3 the spine section of the holding section. 11 is arranged in line with the upper section of the profile spine 13. The stress produced as a result ensures an extra firm grip in the groove 23.

The contact wall 17 is slightly V-shaped and faces upwards away from the profile spine 13. The V shape is formed by a lower leg 24 and an upper leg 25. The upper leg 25 is constructed as a sealing lip 26, and it is adjoined by the upper wall 18 as a link to the profile spine 13. Part of the upper wall 18 is curved outwards, so that on compression it is automatically pressed outwards, away from the cavity 20. A miter cut required to angle the profile can therefore be made in an ideal position, namely well above in the region of the upper wall 18. In a transition region 27 between the profile spine 13 and the upper wall 18 the latter is reinforced with a hard inlay 32 in the form of a core. The thickening of material produces, particularly in the region of deflections in window or door frames, sufficient stability of the sealing profile 10", and it ensures optimum corner filling particularly when a miter cut is made in an ideal position.

According to the invention, the seal 10" according to FIG. 3 is provided with a strip-like, wafer-like hard layer 56 continuing over the length of the seal, on the lower surface of the web portion 240". The latter forms a one-arm leg 241" which is linked pivotably to the lower end 36 of the profile spine 13 or bottom wall 373 and is pivotable into material-free space 211 particularly during inward expansion/compression with its material-free inner groove. In the hinge-like transition region 130 the hard layer 56 is not provided, in order to obtain a particularly pronounced directional and clamping characteristic, as described for FIGS. 1 and 2. Particularly advantageously, the material region 57 linking the web portion 240" is formed from a material which is softer than the material provided with the web hard layer 56.

The hard layer 56 forms a sliding surface which is exposed at the bottom lower surface and which on encountering or expansion butting the groove wall 55 makes the insertion operation considerably easier. In the unassembled state the bottom dimension of the web 240" is greater than the width of the groove 23. With a width of the groove 23 of 5 mm, the bottom dimension of the web 240" is for example 5.5 mm. When fitted in the groove 23 the clamping effect arises, significantly aided by the hard layer 56 acting as a pressure bar in the transverse direction or in the groove width.

The holding lip 22 according to FIG. 3 has a notch 48 at its free end, so that two holding tips 49, 50 which diverge from each other in a V shape are formed. The lower tip 50 is shorter than the upper tip 49. Tips of different length are provided particularly for wooden frames, while the tips for metal frames usually have about the same length. With smooth surfaces, a kind of suction cup is produced by the V shape of the tips. The hard layer 56 extends into the longitudinal edge of the lower tip 50. As a result, the sliding and clamping effects obtained according to the invention and the hinge effects which depend on the direction of pivoting are favored. Particularly advantageously, the free ends of the holding lips 22 which come into fitting contact with the receptacle 14 are formed from a material which is softer than the material provided with the web hard layer.

According to FIG. 3, the profile spine 13 has a spine coating 31 which is appropriately formed from polyolefins. The coating 31 extends, with the exception of a region at the top end 35, over the whole profile spine 13 on the side facing away from the sealing side, over the length of the profile 10". The coating 31 appropriately extends as far as the bottom end 36 of the sealing profile 10". As a result, the coating 31 acts as a sliding aid during insertion of the profile 10" in the groove 23. The coating 31 is, like the hard layer 56, very thin, so that it does not form a wall, but a layer which is even only skin-thin compared with the thickness of the spine wall carrying it, and may be termed a film.

In the example according to FIG. 3, the seal 10" includes three cores 32, 33, 34 which are continuous over the length of the profile and which are formed thread-free from polyolefins and extruded together with the thin coating 31. The cores form additional so-called stretch brakes at the seal top and spine. The core 32 is arranged at the upper top end 35 of the profile spine 13 in the region of the upper wall 18. The core 34 is located at the lower bottom end 36 in the region of the linked holding web 240". The core 33 is arranged more or less centrally on the profile spine 13 in the region of the lower wall 19. The cores 32, 33, 34 can increase the overall stability of the seal 10", while with the hard layer 56 according to the invention on the lower surface of the web portion 240" not only as a material stretch-preventing reinforcement formed, but an element with the numerous functions and advantages described is provided.

Appropriately, the sealing profile 10" according to FIG. 3 can be made of three materials of different hardness. For example the wall 18, the webs 24 and 25 and the free protruding end of the wall 19 are made of thermoplastic elastomer (TPE) with a Shore A hardness of 30° to 60°. The rest of the material can be made of TPE with a Shore A hardness of 60° to 95°, with the exception of the hard layers which are made of polyethylene. Thus only the portions 100 of the sealing profile 10" which are visible when the sealing profile 10" is inserted in the receptacle 14 are made of functional/visible material with a Shore A hardness of 30° to 60°, also termed functional material as it is selected to achieve the required sealing function and should, at the same time, match the necessity of a sufficiently pleasing appearance, since it is visible and not hidden in the receptacle. In contrast thereto, the carrier material of the seal 10" only has a Shore A hardness of 60° to 95°. This arrangement and division into three different cross-sectional areas of material, which allows particularly cheap manufacture, is substantially favored by the bottom hard layer according to the invention.

In FIG. 4 is shown a sealing profile 10'" (elements with corresponding reference numerals to those of FIGS. 1 to 3 are distinguished by a triple prime ('")) with a spine 13 which is formed at the lower end 36 of the holding bottom like the profile 10" in FIG. 3. However, the hard layer 56 extends slightly further into the region of the bottom end 36. Also, over the lower web holding lip 22.11 is provided an additional corresponding web portion holding lip 22.12 which is likewise correspondingly provided with an exposed sliding hard layer 56.1. This involves a double structure, as described with reference to the profile 10' with lips 22.5, 22.7 in FIG. 2.

A sealing profile according to FIG. 5 has a cavity-free arrow bottom whose lower surfaces are provided with the hard layers 41.1 and 42.1. The holding section 11"" (elements with corresponding reference numerals to those of FIGS. 1 to 4 are distinguished by a quadruple prime (""")) is constructed as a double-arrow profile bottom with the pair of lips 22.1 and 22.2, an additional pair of lips 22.3, 22.4 on the bottom trunk 110. These lips, too, are appropriately provided with the sliding hard layers 41.2 and 42.2 on their lower sides. Especially with such an embodiment, as particularly pronounced with the seals 10, 10' according to FIGS. 1 and 2, the sealing section 12"" is extendible much more in the longitudinal direction of the profile than the bottom lower side of the holding section 21"" with the respective hard layer 22. In combination with the transverse position of the hard layer 41, 42, this extendibility leads to an inevitable convex curvature of the profile strand in the longitudinal direction, so that a snap lock which additionally facilitates insertion of the sealing profile is formed. In this respect it may also be appropriate, as shown for example in FIG. 5, to provide a preferably skin-thin but hard coating 41.1, 42.1 on the lower side of the holding bottom continuously, that is, in the apex region 53 as well. In spite of the elasticity of curvature in the apex region 53, the transverse pressure resistance on the lower sides of the legs is preserved, so that according to the invention the upset zone 230 is formed in the transition region 53 of the legs 241"".

In the practical example of FIG. 6, the holding means 21"" (elements with corresponding reference numerals to those of FIGS. 1 to 5 are distinguished by a quintuple prime ("""")) is arranged on the side of the profile spine 13 opposite in the sealing section 12"". In the transition region between the holding means 21"" and the profile spine 13 is provided a thickening of material 61. Within the latter, between the holding section 11"" and the sealing section 12"", is inserted an inlay 62 which helps to increase the dimensional stability, this being also in combination with an arrow bottom, as described with reference to FIG. 5.

In FIG. 6, the free ends of the legs 241"" of the web portion 240"" extend in the transverse direction much longer than the hard layers 41, 42. Thus the tips of the holding lips 22.5, 22.6 also remain free at the bottom lower surface, so that additional adhesion and compression regions of the softer web portion material influenced by the hard layers 41, 42 are formed in the region of the lip tips.

As with the seal 10" according to FIG. 3, it is appropriate also to form the seals 10 of the other practical examples from the three material portions or areas. The portions forming the sealing-functional/visible material are given the reference number 100.

In all the practical examples, the sliding hard layers 41, 42, 56 are appropriately and advantageously relatively thin compared with the thickness of the web portions or legs 240, 241. As the hard layers 41, 42, 56 according to the invention do not form part of the wall material which performs the basic supporting function for the seal 10, they are appropriately made all the thinner, the greater their surface area. In this respect it is important that the web hard layers 41, 42, 56 are not wall portions underpinning the supporting structure of the seal 10, but are to be regarded only as coextruded thin or film layers which act as a stretch brake and as material-compressing elements against pulling/tension and outward/upward expansion.

With respect to manufacture, the web portions 240, 241 are extruded in a die simultaneously from a soft compound for the rubber-like lip material and a hard compound for the hard sliding coating. An integrated hard coating, which can also be understood as an inlay exposed at the surface, is obtained to a certain extent. This coating or inlay acts as a strip-like hard plating or a wafer-like layer which has a planar boundary on the bottom lower side of the seal 10. Already with the smallest layer thicknesses, the effects and functions described are obtained markedly. In this respect, it is also an advantage that, unlike conventional sealing profiles, on account of the coating which is possible with cheap material, the material thickness of the sealing profiles according to the invention can also be remarkably smaller, which on the whole leads to considerable savings of material.

For manufacture of the seals or sealing profiles according to the invention, they are preferably made by a coextrusion process in a single operation. With a sealing profile made of, for example, the three material components described in connection with FIG. 3, a first extruder dispenses the TPE with, e.g., 80° Shore A hardness for the carrier material. A second extruder dispenses the TPE with, e.g., 60° Shore A hardness for the parts which assume a screening or sealing function. A third extruder produces the polyethylene flat strands for the hard layers, inlays and/or coatings. Optionally an additional extruder is provided for making the softer material regions described for FIG. 3 at the web ends on the longitudinal sides (parts 57 or 48 and 49). In a single operation, ready-to-assemble profiles are obtained, which are made avoiding foreign bodies in the profile material and in particular without thread inlays, and are made or assembled without conventional lubricants. The hard layer is applied deliberately as well as locally and partially with precision at the locations at which it is needed. By the method described, not only are the seals shown capable of being made. Sealing profiles can be made with inlays, hard layers and/or coatings, also in sections, as well as sealing profiles as hinge or rebate seals, frame-covering seals or the like.

What is claimed is:

1. An elongate sealing profile, adapted to be inserted in a receptacle of a closure, comprising:

a sealing section extending over substantially an entire length of said sealing profile; and a holding section joined together with said sealing section over substantially the entire length of said sealing profile, said holding section being adapted to be at least partly engaged in said receptacle when inserted therein;

said holding section including means, disposed on opposite sides of the holding section such that a portion of the holding section is disposed therebetween, for assisting sliding insertion of the holding section into the receptacle along an insertion axis in a direction transverse to the length of the sealing profile and for forming a clamping bridge which creates a clamping pressure force transverse to the insertion axis to resist removal of the holding section from the receptacle by compressing the portion of the holding section when a tensile force, in a direction opposite to the insertion direction, tending to remove said profile from said receptacle is applied, said clamping bridge is adapted to create a sealing fit with the receptacle, said portion of the holding section comprising a web portion made of a resilient material.

2. A sealing profile as claimed in claim 1, wherein said means comprises layers of a material harder than said resilient material of said web portion which are arranged on said web portion in a region of said web portion facing towards said receptacle, said layers extending transversely to the direction of insertion of said holding section;

wherein said web portion includes a holding lip, with said layers acting as rigid pivot elements which cause the compression of the portion of the holding section; and wherein said layers are arranged on a bottom side of said holding section so as to form exposed sliding surfaces that slidingly contact the receptacle upon insertion of the holding section in the receptacle.

3. A sealing profile as claimed in claim 2, wherein said web portion further includes at least one leg portion which is linked to a wall of said sealing section and provided with one of said layers, and said at least one leg portion is movable into a material-free space of said holding section.

4. A sealing profile as claimed in claim 2, wherein said web portion has two leg portions arranged in a V shape, each leg portion being linked to an associated sealing profile wall, and said leg portions each being provided with one of said layers and adjoining each other in a region of an apex.

5. A sealing profile as claimed in claim 4, wherein said web portion includes a cavity into which said leg portions are movable.

6. A sealing profile as claimed in claim 4, wherein the region of the apex is free from said layers.

7. A sealing profile as claimed in claim 2, wherein said sealing profile has at least one wall connected to the web portion and at least one of the layers.

8. A sealing profile as claimed in claim 2, wherein said sealing profile is formed from a carrier material, a sealing-functional material to be exposed to the environment and freely visible, and a layer material wherein said functional material is softer than said carrier material and said carrier material is softer than said layer material.

9. A sealing profile as claimed in claim 8, wherein portions of said sealing profile which are visible when said sealing profile is inserted in said receptacle are made of said sealing-functional material.

10. A sealing profile as claimed in claim 8, wherein said sealing-functional material is formed from thermoplastic elastomers with a Shore A hardness of 30°0 to 60°, and said carrier material is formed from thermoplastic elastomers with a Shore A hardness of 60° to 95°.

11. A sealing profile as claimed in claim 8, wherein said layers are made of said layer material.

12. A sealing profile as claimed in claim 11, wherein portions of said sealing profile which are not visible when said sealing profile is inserted in said receptacle, but with the exception of said layers and with the exception of end regions on longitudinal sides of said web portion, are made of said carrier material.

13. A sealing profile as claimed in claim 2, further comprising at least one wall including a plurality of said holding lips each provided with a layer of material harder than the resilient material of the web portion.

14. A sealing profile as claimed in claim 13, wherein said web portion is arranged in a V-shaped orientation.

15. A sealing profile as claimed in claim 2, wherein a side of said holding lip is free from said layers.

16. A sealing profile as claimed in claim 2, wherein said holding lip is linked articulately to a wall of said sealing profile.

17. A sealing profile as claimed in claim 2, wherein a free end of said holding lip is adapted to come into non-sliding contact with said receptacle, and is formed from the resilient material.

18. A sealing profile as claimed in claim 2, wherein each of said layers is thinner than a thickness of said web portion.

19. A sealing profile as claimed in claim 2, wherein at least one of said layers is an inlay introduced into the resilient material of said web portion and exposed at a surface of said web portion.

20. A sealing profile as claimed in claim 2, wherein said layers comprise one of a polyolefin and a polyethylene, and the resilient material is formed from thermoplastic elastomers.

21. A sealing profile as claimed in claim 20, wherein said layers comprise a polyethylene.

* * * * *